US010773742B2

(12) United States Patent
Toshack

(10) Patent No.: US 10,773,742 B2
(45) Date of Patent: Sep. 15, 2020

(54) ADVANCED PREEMPTION USING THE WAYSIDE INSPECTOR AND WIRELESS MAGNETOMETER SENSORS

(71) Applicant: Siemens Canada Limited, Oakville (CA)

(72) Inventor: Frederick Toshack, Saskatchewan (CA)

(73) Assignee: Siemens Industry, Inc., Alpharetta, GA (US)

( * ) Notice: Subject to any disclaimer, the term of this patent is extended or adjusted under 35 U.S.C. 154(b) by 479 days.

(21) Appl. No.: 15/703,412

(22) Filed: Sep. 13, 2017

(65) Prior Publication Data

US 2019/0077434 A1 Mar. 14, 2019

(51) Int. Cl.

| | |
|---|---|
| ***B61L 29/32*** | (2006.01) |
| ***B61L 1/18*** | (2006.01) |
| ***G08G 1/07*** | (2006.01) |
| ***B61L 29/28*** | (2006.01) |
| ***G08G 1/087*** | (2006.01) |
| ***B61L 1/08*** | (2006.01) |

(52) U.S. Cl.

CPC ..... *B61L 29/32* (2013.01); *B61L 1/08* (2013.01); *B61L 1/181* (2013.01); *B61L 29/282* (2013.01); *G08G 1/07* (2013.01); *G08G 1/087* (2013.01)

(58) Field of Classification Search

CPC ..... B61L 29/282; B61L 29/32; B61L 1/08; B61L 1/181

USPC ..... 246/473.1

See application file for complete search history.

(56) References Cited

U.S. PATENT DOCUMENTS

| | | | | |
|---|---|---|---|---|
| 2012/0217351 | A1* | 8/2012 | Chadwick | B61L 29/18 246/169 R |
| 2012/0248261 | A1* | 10/2012 | Nichter | B61L 15/0027 246/125 |
| 2013/0015297 | A1* | 1/2013 | Steffen, II | B61L 29/22 246/125 |
| 2013/0200223 | A1* | 8/2013 | Alexander | B61L 29/28 246/473.1 |
| 2016/0257322 | A1* | 9/2016 | Toshack | B61L 29/22 |
| 2017/0267265 | A1* | 9/2017 | Bartolotti | B61L 29/00 |
| 2019/0077434 | A1* | 3/2019 | Toshack | B61L 29/32 |
| 2019/0144024 | A1* | 5/2019 | Schmidt | B61L 25/021 |
| 2019/0145791 | A1* | 5/2019 | Rempel | G08G 1/096833 701/410 |
| 2019/0337543 | A1* | 11/2019 | Corbo | B61L 25/021 |

* cited by examiner

*Primary Examiner* — Jason C Smith

(57) ABSTRACT

A warning system comprising an advanced preemption system is provided to provide warning of an additional advanced preemption time directly from a wayside inspector to a city traffic controller to turn one or more traffic lights red on a route intersecting with the railroad crossing. The advanced preemption system includes a first set of wireless magnetometers to be installed on a railway track of the railroad crossing on a first side of the railroad crossing. The first set of wireless magnetometers to be located at an advanced preemption crossing start activation point that is being at a distance before an existing crossing start activation point of the railroad crossing to provide the warning of the additional advanced preemption time.

14 Claims, 5 Drawing Sheets

ADVANCED PREEMPTION USING THE WAYSIDE INSPECTOR AND WIRELESS MAGNETOMETER SENSORS

BACKGROUND

1. Field

Aspects of the present invention generally relate to increasing the existing preemption warning time without requiring a redesign and construction of all affected highway grade crossings and existing traffic control systems and more specifically relate to providing warning of a maximum of seconds preemption warning time to automobile traffic controllers.

2. Description of the Related Art

Preemption is a process of railroad crossing controllers feeding a "request to turn red" signal to city traffic light controllers that allow vehicle traffic to approach railway crossings. When railway crossing lights and gates are activated, the city traffic lights on that same route also turn red, preferably before.

Federal Railroad Administration (FRA) and Department of Transport (DOT) safety incentives are requesting longer preemption warning times to turn traffic lights to red earlier for two reasons. First, this allows longer vehicles (e.g., Semi Trailers) to clear the tracks before the crossing lights and gates are activated. Secondly, ensuring vehicle traffic has stopped prior to lights and gate activation.

Existing crossing warning system design only provides warning of a maximum of certain seconds preemption warning time to automobile traffic controllers. Increasing the existing preemption warning time to a certain desired value will require the redesign and construction of all affected highway grade crossings and existing traffic control systems with no benefit to the railroads. Engineering, installation cost and maintenance are another costly concerns.

This increasing of the existing preemption warning time is viewed as an expensive and difficult engineering problem to the railroad industry with no benefit to their business. New crossing warning systems have the technology but require extra cables and detection devices installed to the rails at the time of installation or retrofit.

Therefore, there is a need for effectively increasing the existing preemption warning time without requiring a redesign and construction of all affected highway grade crossings and existing traffic control systems while overcoming various problems and shortcomings of the prior art.

SUMMARY

Briefly described, aspects of the present invention relate to a warning system comprising an advanced preemption system to provide warning of an additional advanced preemption warning time from a railroad crossing controller of a crossing warning system at a railroad crossing to an automobile traffic controller to turn one or more traffic lights red on a route intersecting with the railroad crossing. The advanced preemption system includes a first set of wireless magnetometers to be installed on a railway track of the railroad crossing on a first side of the railroad crossing. The first set of wireless magnetometers to be located at an advanced preemption crossing start activation point that is being at a distance before an existing crossing start activation point of the railroad crossing to provide the warning of the additional advanced preemption warning time.

In accordance with one illustrative embodiment of the present invention, a warning system comprising an advanced preemption system is provided to provide warning of an additional advanced preemption warning time from a railroad crossing controller of a crossing warning system at a railroad crossing to a city traffic controller to turn one or more traffic lights red on a route intersecting with the railroad crossing. The advanced preemption system includes a first set of wireless magnetometers to be installed on a railway track of the railroad crossing on a first side of the railroad crossing. The first set of wireless magnetometers to be located at an advanced preemption crossing start activation point that is being at a distance before an existing crossing start activation point of the railroad crossing to provide the warning of the additional advanced preemption warning time.

In accordance with another illustrative embodiment of the present invention, a warning system comprising an advanced preemption system is provided to provide warning of an additional advanced preemption warning time from a railroad crossing controller of a crossing warning system at a railroad crossing to an automobile traffic controller to turn one or more traffic lights red on a route intersecting with the railroad crossing. The advanced preemption system includes a first set of wireless magnetometers to be installed on a railway track of the railroad crossing on a first side of the railroad crossing and a second set of wireless magnetometers to be installed on the railway track of the railroad crossing on a second side of the railroad crossing.

In accordance with another illustrative embodiment of the present invention, a warning method is provided. The method comprises providing an advanced preemption system to provide warning of an additional advanced preemption warning time from a railroad crossing controller of a crossing warning system at a railroad crossing to an automobile traffic controller to turn one or more traffic lights red on a route intersecting with the railroad crossing. The method further comprises installing a first set of wireless magnetometers on a railway track of the railroad crossing on a first side of the railroad crossing. The method further comprises installing a second set of wireless magnetometers on the railway track of the railroad crossing on a second side of the railroad crossing. The method further comprises locating the first set of wireless magnetometers at an advanced preemption crossing start activation point that is being at a distance before an existing crossing start activation point of the railroad crossing to provide the warning of the additional advanced preemption warning time.

DETAILED DESCRIPTION

Figure 1:
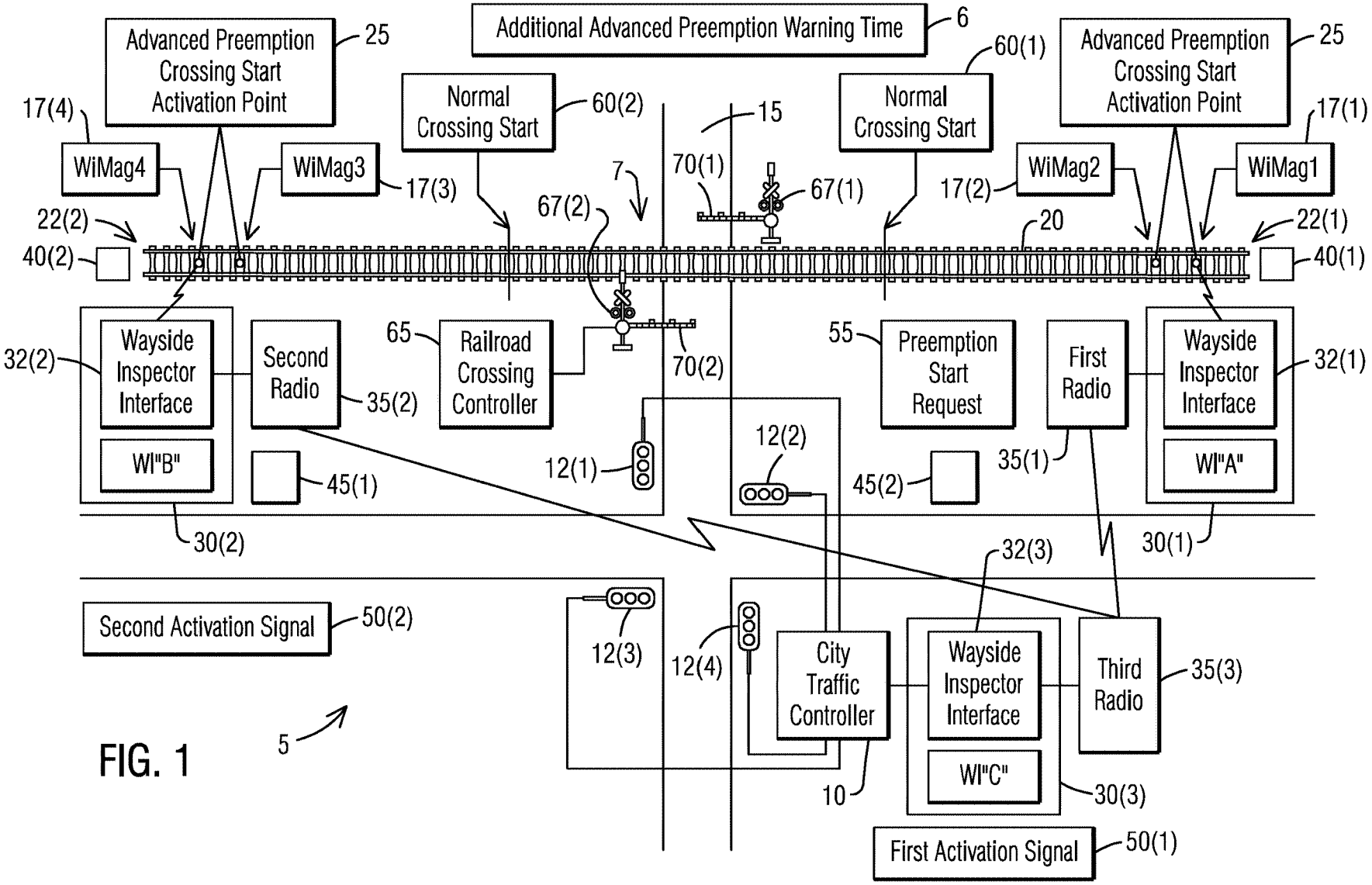
FIG. 1 illustrates a schematic diagram of a warning system comprising an advanced preemption system in accordance with an exemplary embodiment of the present invention.

To facilitate an understanding of embodiments, principles, and features of the present invention, they are explained hereinafter with reference to implementation in illustrative embodiments. In particular, they are described in the context of a warning system comprising an advanced preemption system for providing an advanced preemption using wayside inspectors and wireless magnetometer sensors. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of a warning system comprising an advanced preemption system for providing an advanced preemption using wayside inspectors and wireless magnetometer sensors are described below with reference to FIGS. 1-7. The drawings are not necessarily drawn to scale. Like reference numerals are used throughout to denote like elements.

Consistent with one embodiment of the present invention, FIG. 1 represents a schematic diagram of a railroad warning system comprising an advanced preemption system 5 in accordance with an exemplary embodiment of the present invention. The advanced preemption system 5 to provide warning of an additional advanced preemption time 6 directly from a wayside inspector and connected wireless magnetometer sensors of a crossing warning system at a railroad crossing 7 to a city traffic controller 10 to turn one or more traffic lights 12 (1-4) red on a route 15 intersecting with the railroad crossing 7. Advanced Preemption Time (APT) is the period of time that is the difference between the required maximum highway traffic signal preemption time and the activation of the railroad or light rail transit warning devices. That is, the Advanced Preemption Time (APT) is an additional time given to the traffic signals BEFORE railroad warning devices activate. It is a solution when Minimum Warning Time (MWT) is not enough time for safe and adequate clearance of the crossing. This APT is added to the other times. Maximum Preemption Time (MPT) (Highway) =MWT+APT (Railroad). A traffic signal preemption means the transfer of normal operation of traffic signals to a special control mode. Preemption can be defined as the transfer of normal operation of traffic signals to a special control mode through establishing wired connection between the traffic signal and the railroad control cabinets, also known as interconnect. When the system expects the queue to back up onto the railway crossing, it is time to preempt. The train always has the right of way however the preemption control operation is intended to clear vehicles on the approach that is crossing the tracks before the train arrives at the crossing. The system preempts traffic signals close to railroad crossings to clear any vehicles that may be in danger of being hit by the train before the train arrives at the crossing. Failure can result in severe consequences.

The advanced preemption system 5 includes a first set of wireless magnetometers 17(1-2) to be installed on a railway track 20 of the railroad crossing 7 on a first side 22(1) of the railroad crossing 7. The first set of wireless magnetometers 17(1-2) to be located at an advanced preemption crossing start activation point 25 that is being at a distance before an existing crossing start activation point of the railroad crossing 7 to provide the warning of the additional advanced preemption time 6.

The advanced preemption system 5 further includes a first wayside inspector 30(1) having a first interface 32(1). The first wayside inspector 30(1) is configured to communicate with the first set of wireless magnetometers 17(1-2). The advanced preemption system 5 further includes a first radio 35(1) coupled to the first wayside inspector 30(1). The advanced preemption system 5 further includes a second set of wireless magnetometers 17(3-4) to be installed on the railway track 20 of the railroad crossing 7 on a second side 22(2) of the railroad crossing 7.

The advanced preemption system 5 further includes a second wayside inspector 30(2) having a second interface 32(2). The second set of wireless magnetometers 17(3-4) are configured to communicate with the second wayside inspector 30(2). The advanced preemption system 5 further includes a second radio 35(2) coupled to the second wayside inspector 30(2). The advanced preemption system 5 further includes a third wayside inspector 30(3) having a third interface 32(3). The third wayside inspector 30(3) is configured to communicate with the first and second wayside inspectors 30(1-2). The advanced preemption system 5 further includes a third radio 35(3) coupled to the third wayside inspector 30(3).

The first radio 35(1) of the first wayside inspector 30(1) communicates with the third radio 35(3) of the third wayside inspector 30(3). The second radio 35(2) of the second wayside inspector 30(2) communicates with the third radio 35(3) of the third wayside inspector 30(3) and the third wayside inspector 30(3) communicates with the city traffic controller 10.

The first wayside inspector 30(1) calculates a speed of a first train 40(1) on the railway track 20 for the first train 40(1) going right to left. The second wayside inspector 30(2) calculates a speed of a second train 40(2) on the railway track 20 for the second train 40(2) going left to right.

The first wayside inspector 30(1) for the first train 40(1) going right to left calculates the speed and predicts a right time for when a first advanced preemption signal 45(1) needs to be sent to the city traffic controller 10 and at the right time the first wayside inspector 30(1) sends a first activation signal 50(1) to the third wayside inspector 30(3) and the third wayside inspector 30(3) then forwards the first activation signal 50(1) with no delay to the city traffic controller 10. Likewise, the second wayside inspector 30(2) for the second train 40(2) going left to right calculates the speed and predicts a right time for when a second advanced preemption signal 45(2) needs to be sent to the city traffic controller 10 and at the right time the second wayside inspector 30(2) sends a second activation signal 50(2) to the third wayside inspector 30(3) and the third wayside inspector 30(3) then forwards the second activation signal 50(2) with no delay to the city traffic controller 10.

The speed of the first train 40(1) moving from right to left is calculated in the first wayside inspector 30(1) based on a time between activation of a sensor one 17(1) and a sensor two 17(2) in that order. The speed of the second train 40(2) moving from left to right is calculated in the second wayside inspector 30(2) based on a time between activation of a sensor four 17(4) and a sensor three 17(3) in that order.

The first set of wireless magnetometers 17(1-2) transmit occupancy information to the first wayside inspector 30(1). The first radio 35(1) transmits a preemption start request 55 to the third radio 35(3) and the third wayside inspector 30(3) located with the city traffic controller 10. The third wayside inspector 30(3) has a relay contact to provide a single discreet output indicative of a physical preemption start control request to the city traffic controller 10.

The advanced preemption system 5 further includes a set of normal crossing start points 60(1-2) on the railway track 20. The advanced preemption system 5 further includes a railroad crossing controller 65 that detects an incoming train from right to left or left to right and initiates a crossing activation sequence. The advanced preemption system 5 further includes crossing equipment including a set of warning lights 67(1-2) and a set of gates 70(1-2).

As used herein, "advanced preemption system" refers to a system to provide the warning of the additional advanced preemption warning time to control one or more traffic lights on a route intersecting with a railroad crossing. The "advanced preemption system," in addition to the exemplary hardware description above, refers to a system that is configured to provide an advanced preemption using wayside inspectors and wireless magnetometer sensors. The advanced preemption system can include multiple interacting devices, whether located together or apart, that together perform processes as described herein.

The techniques described herein can be particularly useful for using the wayside inspectors and the wireless magnetometer sensors. While particular embodiments are described in terms of the wayside inspectors and the wireless magnetometer sensors, the techniques described herein are not limited to the wayside inspectors and the wireless magnetometer sensors but can also use other types of controllers and sensors.

Figure 2:
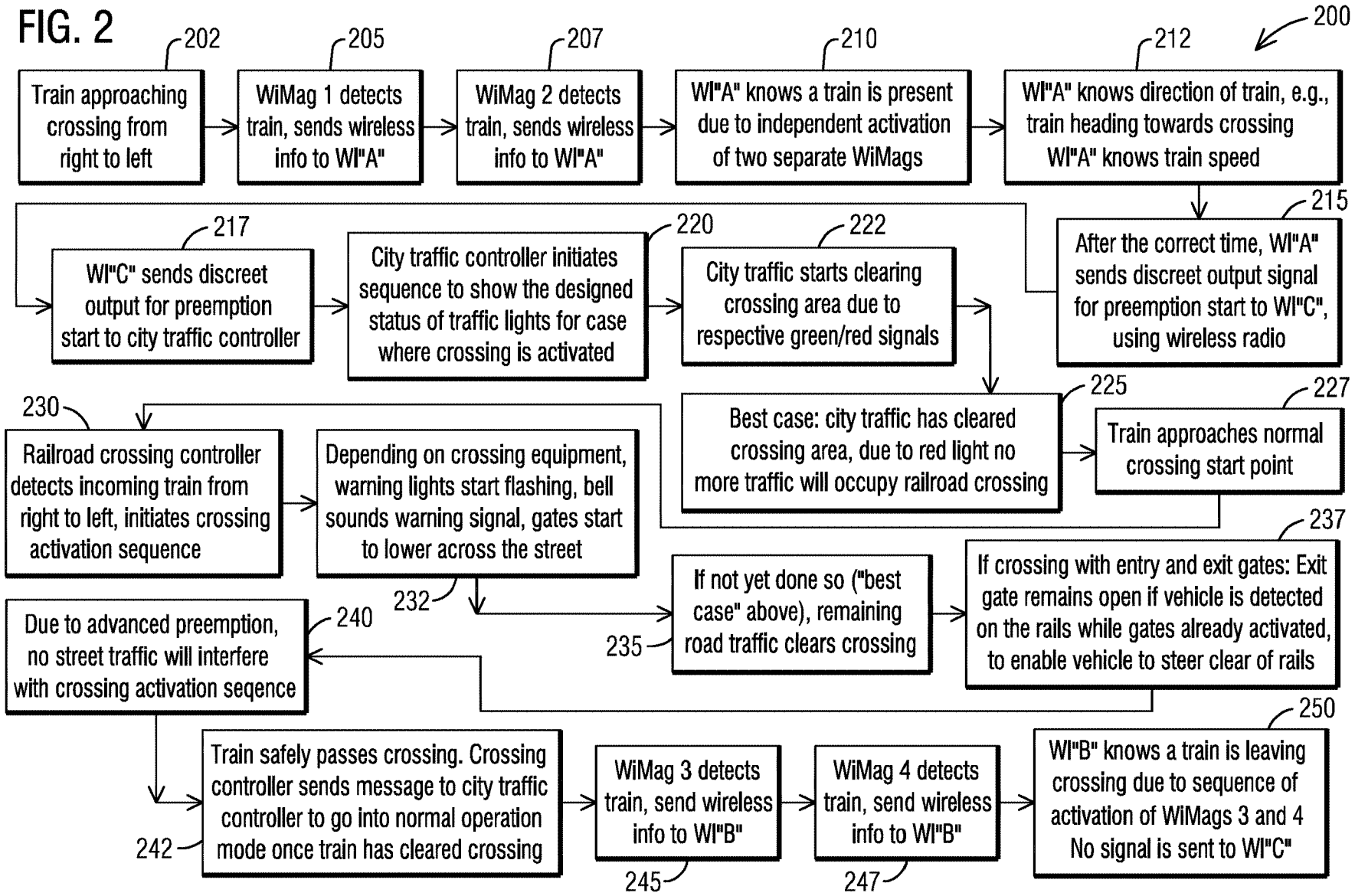
FIG. 2 illustrates a flow chart of a method of an advanced preemption using wayside inspectors and wireless magnetometer sensors according to an exemplary embodiment of the present invention.

Referring to FIG. 2, it illustrates a flow chart of a method 200 of an advanced preemption using the wayside inspectors 30(1-3) and the wireless magnetometer sensors 17(1-4) according to an exemplary embodiment of the present invention. In step 202, a train may be approaching a crossing from right to left. In step 205, a first wireless magnetometer sensor WiMag 1 17(1) of the first set of wireless magnetometers 17(1-2) detects the train and sends wireless info to the first wayside inspector WI "A" 30(1). In step 207, a second wireless magnetometer sensor WiMag 2 17(2) of the first set of wireless magnetometers 17(1-2) detects the train and sends wireless info to the first wayside inspector WI "A" 30(1).

In step 210, the first wayside inspector 30(1) WI "A" knows that a train is present due to an independent activation of two separate wireless magnetometer sensors WiMags—WiMag 1 17(1) and WiMag 2 17(2). In step 212, the first wayside inspector WI "A" 30(1) knows direction of the train, e.g., the train is heading towards the crossing. If sensor 2, then sensor 1 is activated (in that order) then it will not be considered as it would be a train heading away from the crossing 7. If sensor 3, then sensor 4 is activated (in that order) then it will not be considered as it would be a train heading away from the crossing 7.

The first wayside inspector WI "A" 30(1) knows the train speed. A speed of the train moving from right to left is calculated in the first wayside inspector 30(1) WI "A" based on time between activation of sensor 1 and sensor 2 (in that order). A speed of the train moving from left to right is calculated in to the second wayside inspector WI "B" 30(2) based on time between activation of sensor 4 and sensor 3 (in that order).

After a pre-determined time, in step 215, the first wayside inspector WI "A" 30(1) sends a discreet output for preemption start to the third wayside inspector WI "C" 30(3), using the first wireless radio 35(1). The third wayside inspector WI "C" 30(3), in step 217, sends the discreet output for preemption start to the city traffic controller 10. The third wayside inspector WI "C" 30(3) only receives an activation signal for advanced preemption from the first wayside inspector 30(1) WI "A" or from the second wayside inspector WI "B" 30(2) and forwards this with no delay to the city traffic controller 10.

Based on the speed of the first train 40(1), the first wayside inspector 30(1) WI "A" and to the second wayside inspector WI "B" 30(2) calculate when the right time is to actually send the activation signal for the city traffic controller 10. So the first wayside inspector 30(1) WI "A" and to the second wayside inspector WI "B" 30(2) hold that activation signal back until it is time to send it. Then they send it to the third wayside inspector WI "C" 30(3), which passes the signal on with no delay.

The city traffic controller 10, in step 220, initiates a sequence to show the designed status of the traffic lights 12(1-4) for case where the railroad crossing 7 is activated. In step 222, city traffic starts clearing crossing area due to respective green/red signals.

In step 225, a best case would be: city traffic has cleared crossing area, due to a red light no more traffic will occupy the railroad crossing 7. In step 227, a train approaches the normal crossing start point 60(1). In step 230, the railroad crossing controller 65 detects an incoming train from right to left and initiates a crossing activation sequence. Depending on crossing equipment, in step 232, the warning lights 67(1-2) start flashing, bell sounds warning signal, the gates 70(1-2) start to lower across the street In step 235, if not yet done so ("best case" above), remaining road traffic clears the railroad crossing 7.

If the railroad crossing 7 is with entry and exit gates, in step 237, an exit gate remains open if a vehicle is detected on the rails while gates already activated to enable the vehicle to steer clear of the rails. Due to advanced preemption, in step 240, no street traffic will interfere with the crossing activation sequence.

In step 242, the train safely passes the railroad crossing 7. The railroad crossing controller 65 sends a message to the city traffic controller 10 to go into a normal operation mode once the train has cleared the railroad crossing 7.

The wireless magnetometer sensor WiMag 3 17(3), in step 245, detects a train and sends wireless info to the second wayside inspector WI "B" 30(2). The wireless magnetometer sensor WiMag 4 17(4), in step 247, detects the train and sends wireless info to the second wayside inspector WI "B" 30(2). In step 250, the second wayside inspector WI "B" 30(2) knows the train is leaving the railroad crossing 7 due to a sequence of activation of the wireless magnetometer sensor WiMag 3 17(3) and the wireless magnetometer sensor WiMag 4 17(4). Therefore, no signal is sent to the third wayside inspector WI "C" 30(3).

Figure 3:
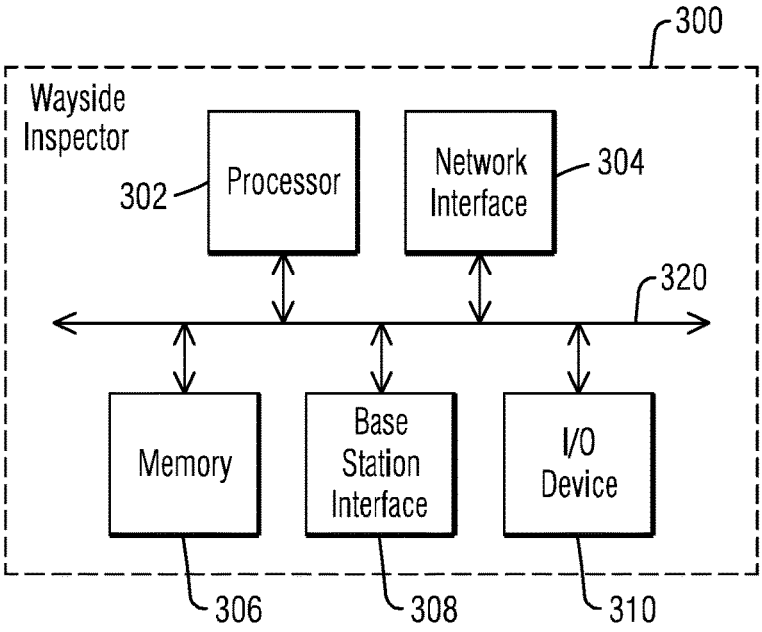
FIG. 3 illustrates a schematic diagram of a wayside inspector in accordance with an exemplary embodiment of the present invention.

Turning now to FIG. 3, it illustrates a schematic diagram of a wayside inspector 300 in accordance with an exemplary embodiment of the present invention. The wayside inspector 300 automates periodic inspection of crossings such as monitoring the state of discrete I/O signals, battery voltages and AC power. From that information, it analyzes the operation of the grade crossing's warning systems and provides a means for inspection of those systems. It can send alarms and inspection report logs to a back office system or can interact thru a web browser to allow field personnel to adjust system settings, view statuses etc.

The wayside inspector 300 includes a processor 302, a network interface component 304, a memory 306, a base station interface component 308 and one or more input/output (I/O) devices 310 (e.g., keyboard, mouse) connected to one or more buses 320. The memory 306 can include volatile and non-volatile memory and can be used to store computer instructions executed by the processor 302 to implement method 200 and other required functions. The memory 306 can be used to store the database, look-up table, data structure, etc. used in method 200 to determine train direction and route. The memory 306 can also temporarily or permanently store train presence, direction and route data input/determined during the method 200.

The I/O devices 310 can be used by railroad personnel to, among other things, query and retrieve the information stored in the memory 306. This way, the railroad personnel can determine how the system is operating and make any necessary changes in the field. The network interface component 304 is used to interface the processor 302 to a network by any suitable communication mechanism. The base station interface component 308 is used to interface the processor 302 to a base station (not shown) by any suitable communication mechanism (e.g., an Ethernet connection if the Wimag base station is used).

Figure 4:
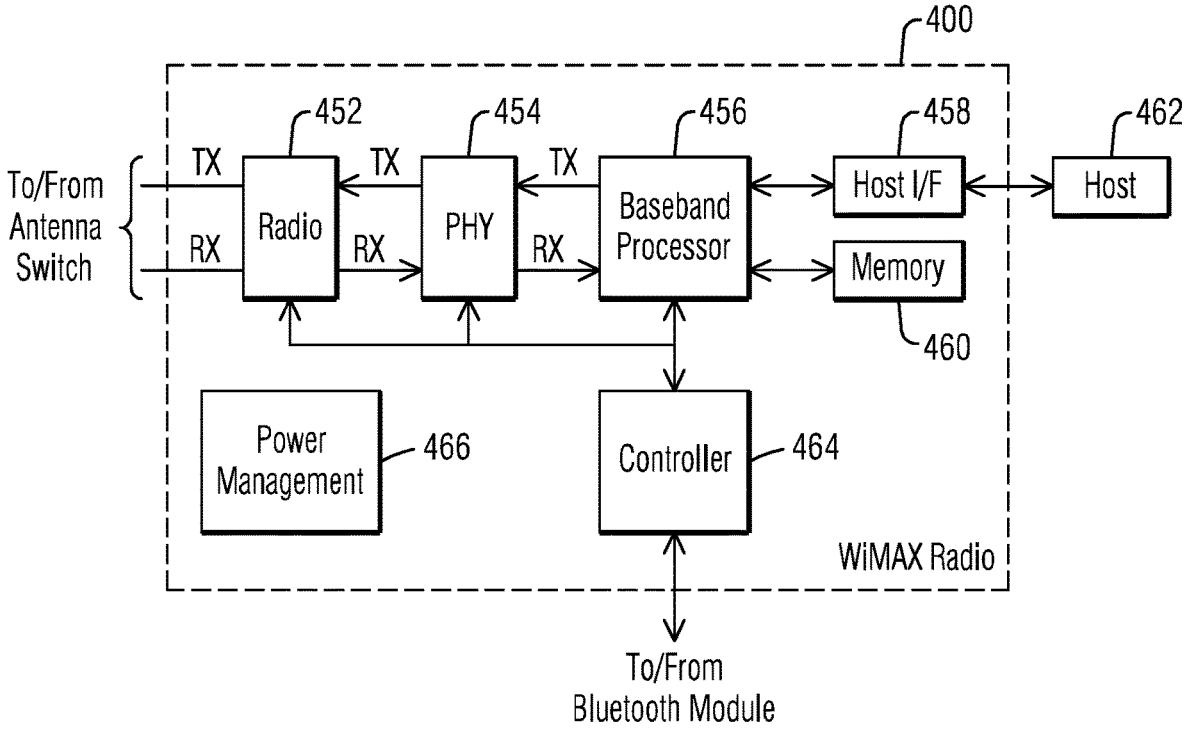
FIG. 4 illustrates a schematic diagram of a WiMAX radio in accordance with an exemplary embodiment of the present invention.

FIG. 4 illustrates a schematic diagram of a WiMAX radio 400 in accordance with an exemplary embodiment of the present invention. The WiMAX radio 400 comprises a host interface (I/F) 458 in communication with a host device 462, a baseband processor/MAC 456, a memory 460, a PHY circuit 454, a radio circuitry 452, a controller 464 and a power management module 466. The radio circuitry 452, coupled to an antenna switch, comprises a RF switch, a band pass filter, a RF front end circuitry, a band pass filter, etc. (not shown). The PHY circuit 454 comprises I and Q signal analog to digital converters (ADCs) and I and Q signal digital to analog converters (DACs) (not shown). The memory 460 comprises any memory devices such as EEPROM, static RAM, FLASH memory, etc. necessary for operation of the processor/MAC. Note that in one embodiment, the mechanism of the invention is implemented as firmware/software that resides in memory 460 and executed on the baseband processor 456 or other controller device or is implemented in hardware in the MAC layer in the processor 456. Alternatively, the mechanism may be implemented in the host or a combination of the host and baseband processor or may be implemented in the controller 464.

The RF front end circuit with the radio functions to filter and amplify RF signals and perform RF to IF conversion to generate I and Q data signals for the ADCs and DACs in the PHY. The baseband processor functions to modulate and demodulate I and Q data, perform carrier sensing, transmission and receiving of frames. The medium access controller (MAC) functions to control the communications (i.e. access) between the host device and applications. The power management circuit 466 is adapted to receive power via a wall adapter, battery and/or power via the host device 462. The host device 462 may comprise PCI, CardBus or USB interfaces.

Figure 5:
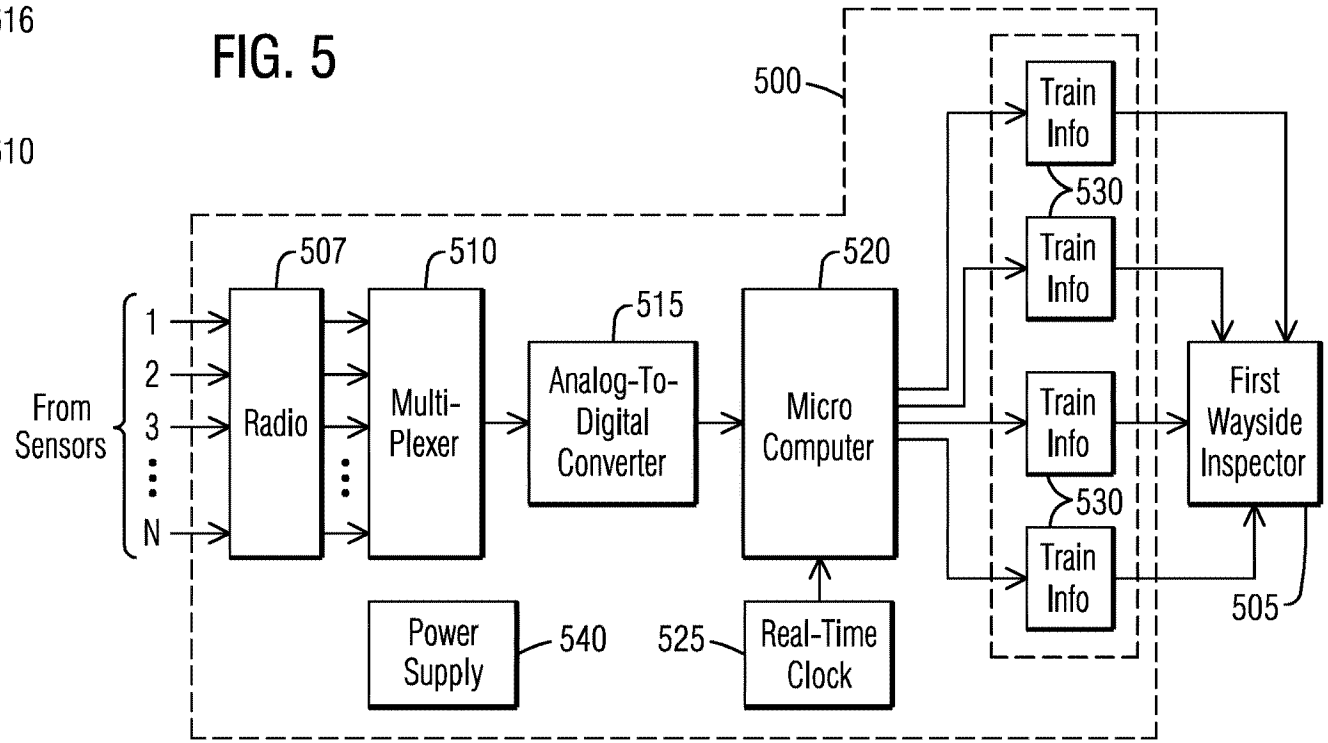
FIG. 5 illustrates a schematic diagram of a wireless magnetometer sensor controller in accordance with an exemplary embodiment of the present invention.

As seen in FIG. 5, it illustrates a schematic diagram of a wireless magnetometer sensor controller 500 in accordance with an exemplary embodiment of the present invention. FIG. 5 is a block diagram of the wireless magnetometer sensor controller 500 and a first wayside inspector 505 and a radio 507. The wireless magnetometer sensor controller 500 has inputs from the Wimag sensors 17(1-2) or 17(3-4) to a multiplexer 510. The sensor signals are multiplexed into one signal line to an analog-to-digital converter 515 for digitizing the signals for inputting into a micro-computer 520 to be time-tagged and processed. A real-time clock 525 provides the timing basis for computer 520. The processed outputs of the computer 520 include train info 530. Other parameter determinations may be processed. The outputs of the computer 530 may go through a modem 535 in a parallel or serial format to be sent on to the first wayside inspector 505. A power supply 540 provides voltages to the sensor power bus.

Figure 6:
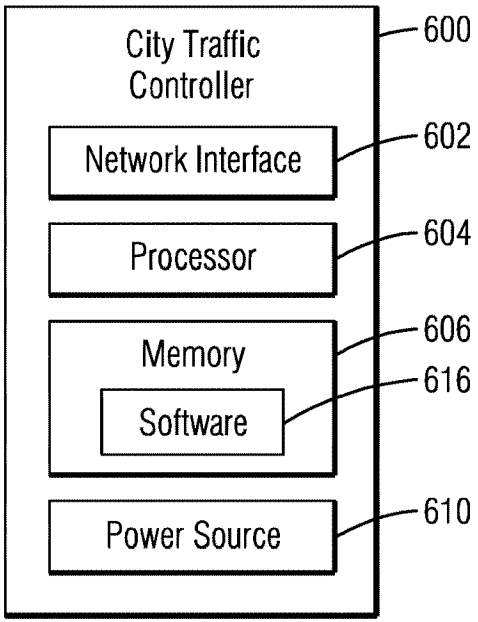
FIG. 6 illustrates a schematic diagram of a city traffic controller in accordance with an exemplary embodiment of the present invention.

As shown in FIG. 6, it illustrates a schematic block diagram of a city traffic controller 600 in accordance with an exemplary embodiment of the present invention. As illustrated, the city traffic controller 600 includes a network interface 602, a processor 604, a memory 606, and a power source 610. In one embodiment, the network interface 602 is configured to connect the city traffic controller 600 to a communications network via an Ethernet cable or other suitable means. The city traffic controller 600 is configured to exchange information with a web service via the communications network and to use the processor 604 and the memory 606 to process and store the received information. In exemplary embodiments, the memory 606 may include any of a wide variety of memory devices including volatile and non-volatile memory devices. In exemplary embodiments, the processor 604 may include one or more processing units.

In exemplary embodiments, the memory 606 of the city traffic controller 600 includes software 616 that includes a variety of applications. One of the applications is traffic control software that controls and monitors the connected traffic signal based on a stored signal plan and/or external detectors such as vehicle and pedestrian detectors. Another application stored in the memory 606 securely connects to a web service over the communications network using a preconfigured address. In exemplary embodiments, the city traffic controller 600 connects to an internet protocol (IP) network that has a routing gateway or proxy server which allows secure connections to services over the Internet. In exemplary embodiments, the memory 606 includes a trusted certificate that is used to secure the connection over the communications network. In addition, the memory 606 stores programmed persistent identification information that is used to securely connect to a desired web service and to identify the city traffic controller 600 to the web service.

Figure 7:
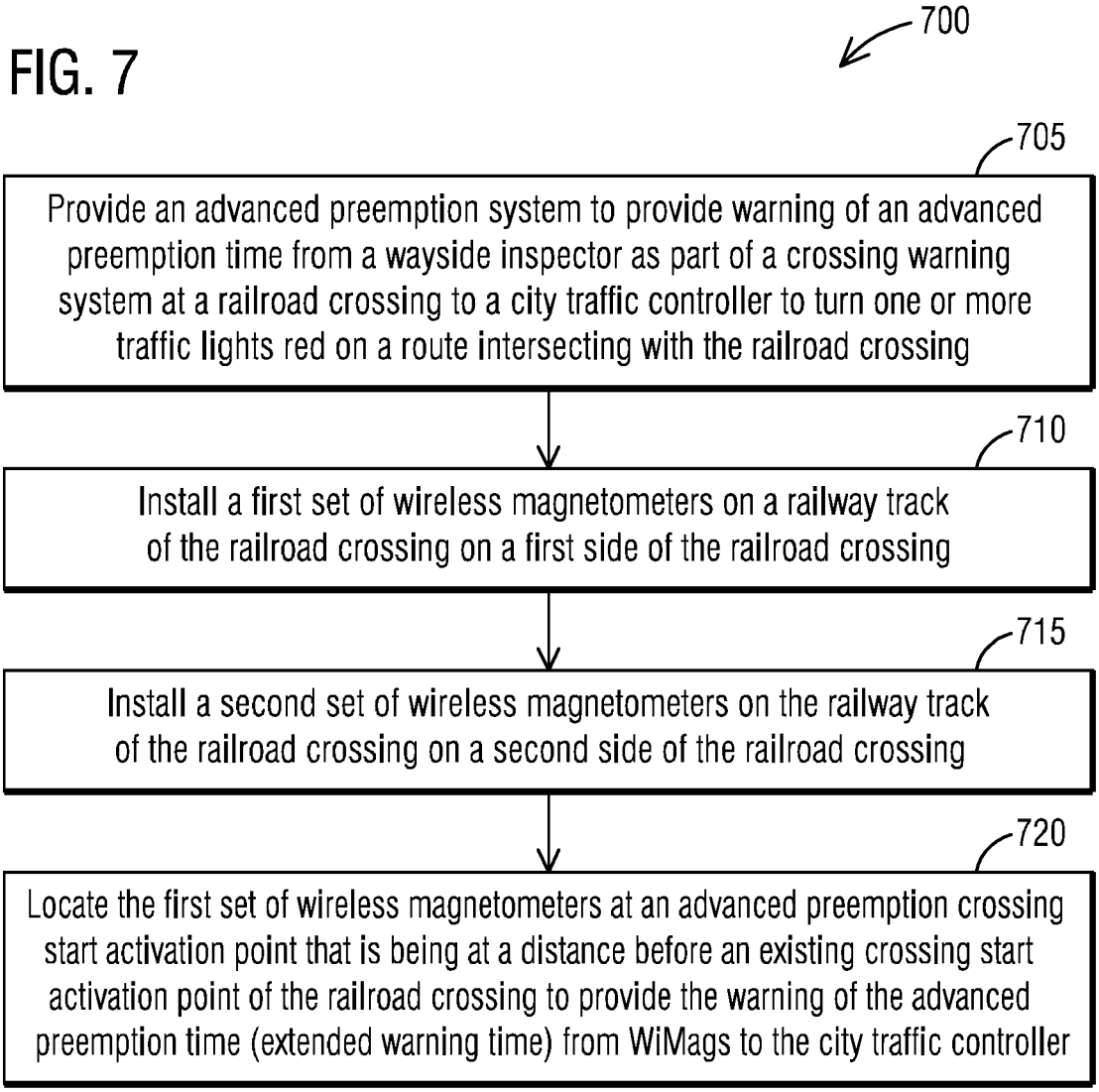
FIG. 7 illustrates a flow chart of a warning method of an advanced preemption according to an exemplary embodiment of the present invention.

In FIG. 7, it illustrates a flow chart of a warning method 700 of an advanced preemption according to an exemplary embodiment of the present invention. Reference is made to the elements and features described in FIGS. 1-6. It should be appreciated that some steps are not required to be performed in any particular order, and that some steps are optional.

In step 705, the warning method 700 includes providing an advanced preemption system to provide warning of an additional advanced preemption time. Advanced preemption time signal is calculated in a wayside inspector WI "A" and then sent to the city traffic controller directly, not going through a railroad crossing controller. The wayside inspector WI "A" is a part of a crossing warning system at a railroad crossing. Advanced preemption time signal is sent directly to a city traffic controller to turn one or more traffic lights red on a route intersecting with the railroad crossing. In step 710, the warning method 700 further includes installing a first set of wireless magnetometers on a railway track of the railroad crossing on a first side of the railroad crossing.

In step 715, the warning method 700 further includes installing a second set of wireless magnetometers on the railway track of the railroad crossing on a second side of the railroad crossing. In step 720, the warning method 700 further includes locating the first set of wireless magnetometers at an advanced preemption crossing start activation point that is being at a distance before an existing crossing start activation point of the railroad crossing to provide the warning of the advanced preemption time (extended warning time) from WiMags to the city traffic controller.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A warning system, the system comprising:

an advanced preemption system including:

a first wayside inspector having a first interface, wherein the advanced preemption system to provide warning of an additional advanced preemption time from directly from the first wayside inspector to a city traffic controller to turn one or more traffic lights red on a route intersecting with a railroad crossing;

a first set of wireless magnetometers to be installed on a railway track of the railroad crossing on a first side of the railroad crossing, wherein the first wayside inspector to communicate with the first set of wireless magnetometers and wherein the first set of wireless magnetometers to be located at an advanced preemption crossing start activation point that is being at a distance before an existing crossing start activation point of the railroad crossing to provide the warning of the additional advanced preemption time;

a first radio coupled to the first wayside inspector;

a second set of wireless magnetometers to be installed on the railway track of the railroad crossing on a second side of the railroad crossing;

a second wayside inspector having a second interface, the second set of wireless magnetometers to communicate with the second wayside inspector; and a second radio coupled to the second wayside inspector.

2. The system of claim 1, wherein the advanced preemption system further including:

a third wayside inspector having a third interface, the third wayside inspector to communicate with the first and second wayside inspectors; and a third radio coupled to the third wayside inspector, wherein the first radio of the first wayside inspector communicates with the third radio of the third wayside inspector, the second radio of the second wayside inspector communicates with the third radio of the third wayside inspector and the third radio of the third wayside inspector communicates with the city traffic controller.

3. The system of claim 2, wherein the first set of wireless magnetometers calculate a speed of a first train on the railway track for the first train going right to left.

4. The system of claim 3, wherein the second set of wireless magnetometers calculate a speed of a second train on the railway track for the second train going left to right.

5. The system of claim 4, wherein the first wayside inspector for the first train going right to left calculates the speed and predicts a right time for when an advanced preemption signal needs to be sent to the city traffic controller and at the right time the first wayside inspector sends an activation signal to the third wayside inspector and the third wayside inspector then forwards the activation signal with no delay to the city traffic controller.

6. The system of claim 5, wherein the speed of the first train moving from right to left is calculated in the first wayside inspector based on a time between activation of a sensor one and a sensor two in that order and wherein the speed of the second train moving from left to right is calculated in the second wayside inspector based on a time between activation of a sensor four and a sensor three in that order.

7. The system of claim 6, wherein the first set of wireless magnetometers transmit occupancy information to the first wayside inspector.

8. The system of claim 7, wherein the first radio transmits a preemption start request to the third radio and the third wayside inspector located with the city traffic controller.

9. The system of claim 8, wherein the third wayside inspector having a relay contact to provide a single discreet output indicative of a physical preemption start control request to the city traffic controller.

10. A warning system, the system comprising:

an advanced preemption system including:

a first wayside inspector having a first interface, wherein the advanced preemption system to provide warning of an additional advanced preemption time from the first wayside inspector as part of a crossing warning system at a railroad crossing to an automobile traffic controller to turn one or more traffic lights red on a route intersecting with the railroad crossing;

a first set of wireless magnetometers to be installed on a railway track of the railroad crossing on a first side of the railroad crossing, the first wayside inspector to communicate with the first set of wireless magnetometers;

a second set of wireless magnetometers to be installed on the railway track of the railroad crossing on a second side of the railroad crossing;

a second wayside inspector having a second interface, the second set of wireless magnetometers to communicate with the second wayside inspector;

a third wayside inspector having a third interface, the third wayside inspector to communicate with the automobile traffic controller;

a first radio coupled to the first wayside inspector;

a second radio coupled to the second wayside inspector; and a third radio coupled to the third wayside inspector.

11. The system of claim 10, wherein the first set of wireless magnetometers to be located at an advanced preemption crossing start activation point that is being at a distance before an existing crossing start activation point of the railroad crossing to provide the warning of the additional advanced preemption warning time.

12. The system of claim 10, wherein the first radio of the first wayside inspector communicates with the third radio of the third wayside inspector, the second radio of the second wayside inspector communicates with the third radio of the third wayside inspector and the third wayside inspector communicates with the city traffic controller.

13. The system of claim 10, wherein the first wayside inspector calculates a speed of a first train on the railway track for the first train going right to left.

14. The system of claim 13, wherein the second wayside inspector calculates a speed of a second train on the railway track for the second train going left to right.

* * * * *